US012767999B2

(12) United States Patent
Grenzi

(10) Patent No.: US 12,767,999 B2
(45) Date of Patent: Oct. 20, 2026

(54) TRACK LINK PRODUCTION METHOD

(71) Applicants: Berco S.p.A., Copparo/Ferrara (IT); thyssenkrupp AG, Essen (DE)

(72) Inventor: Francesco Grenzi, Ferrara (IT)

(73) Assignees: Berco S.p.A., Copparo/Ferrara (IT); thyssenkrupp AG, Essen (DE)

( * ) Notice: Subject to any disclaimer, the term of this patent is extended or adjusted under 35 U.S.C. 154(b) by 401 days.

(21) Appl. No.: 18/698,703

(22) PCT Filed: Oct. 4, 2022

(86) PCT No.: PCT/EP2022/077534
§ 371 (c)(1),
(2) Date: Apr. 4, 2024

(87) PCT Pub. No.: WO2023/057430
PCT Pub. Date: Apr. 13, 2023

(65) Prior Publication Data

US 2024/0417819 A1 Dec. 19, 2024

(30) Foreign Application Priority Data

Oct. 7, 2021 (EP) ..... 21201429

(51) Int. Cl.
*C21D 9/00* (2006.01)
*C21D 1/18* (2006.01)
(Continued)

(52) U.S. Cl.
CPC ..... *C21D 9/0087* (2013.01); *C21D 1/18* (2013.01); *C21D 6/004* (2013.01); *C21D 6/005* (2013.01);
(Continued)

(58) Field of Classification Search
CPC ..... C21D 9/0087; C21D 1/18; C21D 6/004; C21D 6/005; C21D 6/008; C21D 8/00;
(Continued)

(56) References Cited

U.S. PATENT DOCUMENTS 6,782,689 B1 8/2004 Philipp
7,040,080 B2 5/2006 Okawa et al.
2003/0230069 A1* 12/2003 Okawa ..... C21D 1/18 59/35.1

FOREIGN PATENT DOCUMENTS

CN 102453841 A 5/2012
CN 103352170 A 10/2013
(Continued)

OTHER PUBLICATIONS

English Translation of International Search Report issued in PCT/EP2022/077534, dated Jan. 11, 2023.

*Primary Examiner* — Adil A. Siddiqui
(74) *Attorney, Agent, or Firm* — thyssenkrupp North America, LLC

(57) ABSTRACT

The present disclosure refers to a method for manufacturing a track link for a running gear of a tracked vehicle, comprising the following method steps: P1) providing a forging blank of steel, P2) hot forging the forging blank to produce a track link blank and hot trimming of the track link blank to form at least a wheel tread part of the track link blank, P3) quenching the track link blank to a temperature T1, P4) low temperature tempering the track link blank at a temperature of 200±50° C., and P5) finish machining the tempered track link blank to produce the final shape of the track link.

8 Claims, 1 Drawing Sheet

(51) Int. Cl.

| | |
|---|---|
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/48*** | (2006.01) |

(52) U.S. Cl.
CPC ..... *C21D 6/008* (2013.01); *C21D 8/00* (2013.01); *C22C 38/002* (2013.01); *C22C 38/02* (2013.01); *C22C 38/04* (2013.01); *C22C 38/42* (2013.01); *C22C 38/44* (2013.01); *C22C 38/48* (2013.01)

(58) Field of Classification Search
CPC .... C21D 2261/00; C21D 1/22; C22C 38/002; C22C 38/02; C22C 38/04; C22C 38/42; C22C 38/44; C22C 38/48
See application file for complete search history.

(56) References Cited

FOREIGN PATENT DOCUMENTS

| | | | |
|---|---|---|---|
| CN | 104662179 | A | 5/2015 |
| CN | 105723004 | A | 6/2016 |
| CN | 111360488 | A | 7/2020 |
| EP | 0072355 | A1 | 2/1983 |
| EP | 0700739 | A1 | 3/1996 |
| EP | 3119916 | A1 | 1/2017 |

* cited by examiner

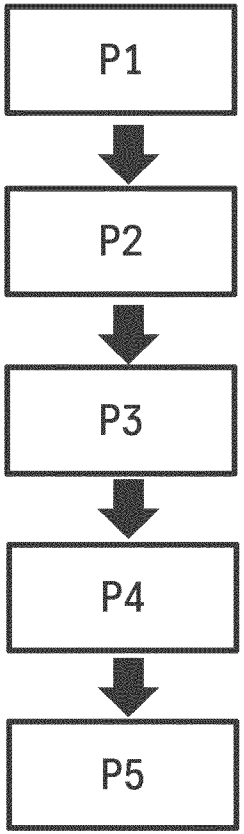
P1
P2
P3
P4
P5

TRACK LINK PRODUCTION METHOD

CROSS REFERENCE TO RELATED APPLICATIONS

This application is a U.S. National Stage Entry of International Patent Application Serial Number PCT/EP2022/077534, filed Oct. 4, 2022, which claims priority to European Patent Application No. EP 21201429.4, filed Oct. 7, 2021, the entire contents of both of which are incorporated herein by reference.

FIELD

The present disclosure generally relates to a method of producing a track link. Track links are used in track chains of tracked vehicles, such as construction machinery vehicles and earth moving machinery vehicles with track chains.

BACKGROUND

EP 0 700 739 B1 discloses a method for producing a vehicular endless track link comprising the steps of:

forging a link material (1) of low-carbon boron steel at a temperature about 1200° C.;

quench-hardening said link material (1) by rapidly cooling said link material (1) from a temperature above about 760° C. so that a metallic crystal structure of said link material (1) is converted to martensite; and tempering said link material (1) at a temperature of about 200° C.

According to EP 0 700 739 B1, the forging step can include the step of hot-trimming at least one end surface of the link material. According to an embodiment of the invention disclosed in EP 0 700 739 B1, the link material is forged at about 1200° C. (i.e., 1200±50° C.) to form a preliminary link shape. During the forging step, opposite end surfaces 2 and 3 (one of the end surfaces being designated as a roller contact surface), nut seat surfaces 4, a pin hole 5, and a bushing hole 6 are hot-trimmed (see FIG. 2). Because the temperature of about 1200° C. affects the mechanical properties of the link material inasmuch as the link material is thereby softened, the hot-trimming is easily performed and the link material can be fashioned into a substantially final link shape.

EP 0 700 739 B1 discusses the tempering step at a temperature of about 200° C. in more detail. It is disclosed that "about 200° C." is meant to mean 200±50° C. The reason for the range of 200±50° C. for the low-temperature tempering is explained as follows:

The relationships among the hardness, the impact value (toughness), and the tempering temperature for the link manufactured using the method according to the invention disclosed in EP 0 700 739 B1 are illustrated in FIG. 9. When the tempering temperature is in the range of 150° C.-250° C., that is, 200±50° C., the hardness is almost constant and is about HRC 46, and also the toughness is almost constant and is in the range of 7.0 to 7.5 Kg·m/cm2, even though the tempering temperature changes. This means that, in the range of 200±50° C., the hardness and toughness are substantially uneffected by a change in the tempering temperature. FIG. 9 also shows that in the range of 200±50° C. tempering temperature, the tensile strength is also substantially constant at a value of approximately 145 kg/mm2, which equals approximately 1.420 MPa.

A track link produced according to the production method described in EP 0 700 739 B1 therefore has a combination of mechanical material properties comprising a hardness of 46 HRC, a tensile strength of well below 1.450 MPa and a toughness of 7-7.5 Kg·m/cm2.

U.S. Pat. No. 7,040,080 B2 discloses a method for producing a track link, said method comprising the following production steps:

hot forging a link material;

machining the link material;

then applying a heat treatment process to an entirety of the link material, said heat treatment process comprising quenching and low temperature tempering the entirety of the link material;

then tempering parts of the link material which at least one of: (i) require high dimensional accuracy, and (ii) are susceptible to delayed failure caused by high stress due to press-fitting; and finish machining said parts of the link material.

Because of the separate partial tempering step required by the method according to U.S. Pat. No. 7,040,080 B2, this production method is costly and time consuming. The extra tempering step of individual track link parts also consumes additional energy.

Regarding the mechanical material properties of the track link material produced by the proposed production method, U.S. Pat. No. 7,040,080 B2 discloses values for the hardness for three specific track link materials at the surface and in the center core of the track link, as well as grain size of the center core of the track link. The three specific steel compositions for which hardness values are disclosed in U.S. Pat. No. 7,040,080 B2 are called "SNCM431", "SCM 440 Mod." and SCM435" (see Table 1). Out of these three steel compositions, only SCM 440 Mod. comprises Nb as an alloy compound, and this steel composition has a high concentration in Carbon (C=0.4%), high concentrations in Sulphur (S=0,008%) and Chromium (Cr=1.01%), as well as a low concentration in Molybdenum (Mo=0.5%). Also, SCM 440 Mod. contains Boron (B=0.03%).

U.S. Pat. No. 7,040,080 B2 only discusses hardness and is silent about other important material properties such as tensile strength and toughness of the track link material produced according to the claimed production method.

Thus a need exists to provide a track link production method which allows the cost efficient and lean production of track links, wherein the track link material has high hardness, high tensile strength and high toughness in combination with each other. The present disclosure also provides an efficiently produced track link which has both a high surface hardness and core hardness, as well as a high tensile strength and a high toughness.

BRIEF DESCRIPTION OF THE FIGURES

So that those skilled in the art to which the subject invention appertains will readily understand how to make and use the devices and methods of the subject invention without undue experimentation, preferred embodiments thereof will be described in detail herein below with reference to certain figures, wherein:

FIG. 1 shows schematically process steps of one example of the production method according to the disclosure.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

According to the present invention, the method for manufacturing a track link for a running gear of a tracked vehicle, comprising the following method steps:

P1) providing a forging blank of steel,

P2) hot forging the forging blank to produce a track link blank and hot trimming of the track link blank to form at least a wheel tread part of the track link blank, P3) quenching the track link blank to a temperature T1, P4) low temperature tempering the track link blank at a temperature of 200±50° C., and P5) finish machining the tempered track link blank to produce the final shape of the track link.

The production method according to the present invention is characterized in that a starting temperature for the quenching of the track link blank in step P3) is 880±10° C. and the temperature T1 is a temperature in the range between 235° C. and 190° C., wherein the steel of the forging blank has the following composition (in % by weight):

0.25-0.33% Carbon (C),
0.75-1.05% Manganese (Mn),
0.15-0.35% Silicon (Si),
0.75-0.85% Molybdenum (Mo),
0.65-0.95% Chromium (Cr),
0.65-0.95% Nickel (Ni),
0.02-0.05% Niobium (Nb),
optionally up to a maximum of 0.015% Phosphorus (P),
optionally up to a maximum of 0.005% Sulphur(S),
optionally up to a maximum of 0.2% Copper (Cu),
optionally up to a maximum of 0.005% Calcium (Ca),
the balance being iron and unavoidable impurities.

It was found that when a steel forging blank having the aforementioned steel composition and subjected to the production steps according to claim 1 a track link is obtained having very good mechanical properties, including (in combination with each other) a surface hardness of >44 HRC, a core hardness of >44 HRC, a tensile strength of >1.500 MPa, and a toughness of at least 20 J at −45° C. Due to the high value of surface and core hardness, the track link according to the invention features a very good wear resistance. The high value of tensile strength of the track link material leads to a very good resistance of the track link against deformation under heavy loads. Due to the high toughness of the track link material, the track link has a high resistance to cracking, especially in the pin hole and bushing hole areas.

Thus, the present invention provides a track link that has a particularly long service life, while at the same time being inexpensive to manufacture.

In principle, the quenching in process step P3) can be performed directly after the hot forging and hot trimming step P2), utilizing the residual heat of the track link blank from the hot forging and hot trimming step P2). However, it may be desirable to decouple production steps P2) and P3) from each other.

Therefore, in one embodiment of the present production method according to the invention, the quenching in process step P3) comprises a reheating of the track link blank up to a temperature of 880±10° C., and a rapid cooling of the reheated track link blank ( ) to a temperature T1 between 190° C. and 235° C. It is the temperature in which this steel reach the most higher resistance and toughness In one embodiment of the present production method according to the invention, the reheating in process step P3) includes heating the track link blank from 20° C. up to 879° C. at an average temperature rate of 7.7° C./min. This value is related to the chemical of the steel and it is crucial to obtain the maximum level of toughness.

The track link provided by the present invention has very good mechanical properties, including (in combination with each other) a surface hardness of >44 HRC, a core hardness of >44 HRC, a tensile strength of >1.500 MPa, and a toughness of at least 20 J at −45° C. Due to the high value of surface and core hardness, the track link according to the invention features a very good wear resistance. The high value of tensile strength of the track link material leads to a very good resistance of the track link against deformation under heavy loads. Due to the high toughness of the track link material, the track link has a high resistance to cracking, especially in the pin hole and bushing hole areas. Therefore, the track link has a particularly long service life, while at the same time being inexpensive to manufacture.

In one embodiment of the track link according to the present invention, the track link material also has a yield strength $R_{p0,2}$ of >1.100 (1200 typically) MPa and therefore has a particularly high resistance to plastic deformation during the hard conditions under use in construction and earth moving machinery.

As known to the person skilled in the art, the tensile strength, the yield strength and the toughness are determined by standardized measurement methods. For determining the tensile strength and the yield strength such standardized measurement methods are ASTM E8/E8M and DIN EN ISO 6892-1. For determining the toughness such standardized measurement methods are ASTM E23 and ISO 148-1.

The invention is described in more detail with the help of the FIGURE. The only FIGURE shows schematically the process steps of the production method according to the invention.

FIG. 1 shows the process steps of the production method according to the present invention. In process step P1) there is provided a forging blank made out of steel. In process step P2) the forging blank is hot forged to produce a track link blank, and the track link blank is hot trimmed to form a wheel tread part of the track link blank.

In process step P3) the track link blank is quenched to a temperature T1. The starting temperature for the quenching of the track link blank is 880±10° C. The temperature T1 is a temperature in the range between 235° C. and 190° C.

If the track link blank is within the temperature range of 880±10° C. after the process step P2) has been finished, then the track link blank can be quenched immediately after completion of process step P2). But according to the present invention it is also possible to allow the track link blank to cool down to a temperature below 880-10° C. after process step P2). The track link blank may be allowed, for example, to cool down to room temperature after process step P2). In this way, the process steps P2) and P3) can be separated from one another, i.e. the process step P3) can be carried out at a later point in time independently of process step P2) and at a place different from the place where process step P2) was carried out.

If the track link blank is allowed to cool down to a temperature below 880-10° C., then the process step P3) comprises a reheating of the track link blank to a temperature in the range of 880±10° C. prior to quenching.

The quenching in process step P3) comprises a rapid cooling of the reheated track link blank to a temperature T1 between 235° C. and 190° C.

According to an embodiment of the present invention, the reheating in process step P3) includes heating the track link blank from 20° C. up to 879° C., e.g. at an average heating rate between 7 and 8° C./min, for example at a heating rate of 7.7° C./min. The mentioned heating rate and the mentioned heating temperature have proven to produce good results when used with a steel composition according to the present invention.

In the process step P4) the track link blank is subjected to a low temperature tempering at a temperature of approximately 200° C. for a period of time of 260 minutes.

In the process step P5) the tempered track link blank is subjected to a finish machining in order to produce the final shape of the track link.

According to the present invention, the described manufacturing process is carried out on a forging blank comprising the following composition (in % by weight):

0.25-0.33% Carbon (C),
0.75-1.05% Manganese (Mn),
0.15-0.35% Silicon (Si),
0.75-0.85% Molybdenum (Mo),
0.65-0.95% Chromium (Cr),
0.65-0.95% Nickel (Ni),
0.02-0.05% Niobium (Nb),
optionally up to a maximum of 0.015% Phosphorus (P),
optionally up to a maximum of 0.005% Sulphur(S),
optionally up to a maximum of 0.2% Copper (Cu),
optionally up to a maximum of 0.005% Calcium (Ca),
the balance being iron and unavoidable impurities.

The described manufacturing process leads to a track link having very good mechanical properties, including (in combination with each other) a surface hardness of >44 HRC, a core hardness of >44 HRC, a tensile strength of >1.500 MPa, and a toughness of at least 20 J at −45° C. Due to the high value of surface and core hardness, the track link according to the invention features a very god wear resistance. The high value of tensile strength of the track link material leads to a very good resistance of the track link against deformation under heavy loads. Due to the high toughness of the track link material, the track link has a high resistance to cracking, especially in the pin hole and bushing hole areas.

Thus, the present invention provides a track link that has a particularly long service life, while at the same time being inexpensive to manufacture.

What is claimed is:

1. A method for manufacturing a track link for a running gear of a tracked vehicle, the method comprising:

P1) providing a forging blank of steel;

P2) hot forging the forging blank to produce a track link blank and hot trimming of the track link blank to form at least a wheel tread part of the track link blank;

P3) quenching the track link blank to a temperature T1, wherein a starting temperature for the quenching of the track link blank in step P3) is 880±10° C. and the temperature T1 is a temperature in the range between 235° C. and 190° C.;

P4) low temperature tempering the track link blank at a temperature of 200±50° C.;

P5) finish machining the tempered track link blank to produce the final shape of the track link; and wherein the steel of the forging blank has the following composition (in % by weight):

0.25-0.33% Carbon (C),
0.75-1.05% Manganese (Mn),
0.15-0.35% Silicon (Si),
0.75-0.85% Molybdenum (Mo),
0.65-0.95% Chromium (Cr),
0.65-0.95% Nickel (Ni),
0.02-0.05% Niobium (Nb), and
up to a maximum of 0.015% Phosphorus (P),
the balance being iron and unavoidable impurities.

2. The method of claim 1, wherein the steel further comprises:

up to a maximum of 0.005% Sulphur(S).

3. The method of claim 2, wherein the steel further comprises:

up to a maximum of 0.2% Copper (Cu).

4. The method of claim 3, wherein the steel further comprises:

up to a maximum of 0.005% Calcium (Ca).

5. The method of claim 1, wherein the quenching in process step P3) comprises a reheating of the track link blank up to a temperature of 880±10° C., and a rapid cooling of the reheated track link blank to a temperature T1 between 190° C. and 235° C.

6. The method of claim 5, wherein the reheating includes heating the track link blank from 20° C. up to 879° C. at an average temperature of 7.7° C./min.

7. A track link for a running gear of a tracked vehicle obtainable by a production process according to claim 1, wherein the track link material has: a surface hardness of >44 HRC; a core hardness of >44 HRC; a tensile strength of >1,500 MPa; and a toughness of at least 20 J at −45° C.

8. The track link of claim 7, wherein the track link material has a yield strength $R_{p0.2}$ of >1,100 MPa.

* * * * *